US005778275A

United States Patent [19]

Yamashita

[11] Patent Number: 5,778,275

[45] Date of Patent: Jul. 7, 1998

[54] PROCESSING DEVICE FOR PHOTOGRAPHIC MATERIALS AND AUTOMATIC DEVELOPING MACHINE USING THE SAME

[75] Inventor: Miyuki Yamashita, Tokyo, Japan

[73] Assignee: Hirakawa Kogyo Sha Co., Ltd., Tokyo, Japan

[21] Appl. No.: 710,844

[22] Filed: Sep. 23, 1996

[51] Int. Cl.[6] ..... G03D 13/04

[52] U.S. Cl. ..... 396/643; 396/612; 396/636; 396/645

[58] Field of Search ..... 396/636, 642, 396/643, 644, 645, 646, 612, 617, 622, 624, 626, 630, 627

[56] References Cited

U.S. PATENT DOCUMENTS

| | | | |
|---|---|---|---|
| 3,738,251 | 6/1973 | Hauser | 396/636 |
| 4,099,194 | 7/1978 | Kummerl | 396/645 |
| 4,708,453 | 11/1987 | Fryda et al. | 396/636 |

*Primary Examiner*—A. A. Mathews

*Attorney, Agent, or Firm*—Millen, White, Zelano, & Branigan, P.C.

[57] ABSTRACT

Provided is a photographic processing device comprising at least one pair of a tray section and an upper section, which are each made by integral molding, arranged so as to form a space. A photosensitive material is passed through the space with its emulsion side turned to the upper plane of the tray section. The upper plane of the tray section and the lower plane of the upper section are equipped with free-rotation rollers for supporting the conveyance of a photographic material. For the adaptation to the width of a photosensitive material to be passed therethrough, two or more of the pairs of the sections are joined together in the width direction with packing. Further, there is provided an automatic developing machine using the foregoing processing device, wherein just before the passage of a photosensitive material through the processing device a processing solution is supplied to the emulsion side of the photosensitive material and spread in a thin layer over the emulsion side during the passage to effect the processing.

12 Claims, 4 Drawing Sheets

PROCESSING DEVICE FOR PHOTOGRAPHIC MATERIALS AND AUTOMATIC DEVELOPING MACHINE USING THE SAME

FIELD OF THE INVENTION

The present invention relates to a processing device used in an automatic developing machine for photographic materials and, more particularly, to parts suitable for a developing or fixing device in which a reduced amount of processing solution is used, and further to an automatic developing machine using such parts.

BACKGROUND OF THE INVENTION

In recent years, automatic developing machines have been prevailingly used for processing photosensitive materials. The process of photographic processing requires delicate operations. From the viewpoint of ensuring high quality and high efficiency in photographic processing, every developing machine has have its own limitation on the width of photosensitive materials to be processed therewith, and so the sizes of a developing tank, a fixing tank, trays and so on installed therein have been chosen so as to suit to such a width limitation.

In other words, conventional developing machines have a disadvantage in that they each require a developing tank and other fittings having a width specified thereby individually.

Further, as for the rollers for conveying photographic materials in the development-processing part, the width direction thereof has so far been covered totally by one roller alone. Therefore, such a roller has defects that it becomes more difficult to secure the accuracy and the production cost becomes higher the greater the width of the roller is.

As a result of our intensive studies to solve the aforementioned problems, it has been found that, when a roller and a processing device comprising a tray and rollers are each divided into small parts of the same shape capable of being joined together in the width direction and each of the parts is made integrally using, e.g., an injection molding system, the adaptation to the width of photographic materials to be processed can be effected with ease and high accuracy by joining some of those parts in the width direction, thereby achieving the present invention.

SUMMARY OF THE INVENTION

A first object of the present invention is therefore to provide a processing device comprising a plurality of parts which are same in shape and joined in the width direction to enable easy adaptation to the width of photographic materials to be processed therein.

A second object of the present invention is to provide parts to compose a processing device and parts for rollers used therein which can be made economically and used commonly however wide photosensitive materials to be processed may be.

A third object of the present invention is to provide an inexpensive processing device comprising parts of same shape which are each composed of sections molded integrally.

A fourth object of the present invention is to provide an inexpensive, light-weight processing device which requires no roller long enough to cover the whole width thereof.

A fifth object of the present invention is to provide an inexpensive, light-weight automatic developing machine for photographic materials.

The above-described objects are attained with a processing device for photographic materials and an automatic developing machine using such a processing device: with the processing device comprising as the minimum unit of its parts a pair of sections;

one of the sections being a tray section which is made of a integrally molded material, the upper surface of which has a gently concave form and at least three indented zones for arranging thereon free-rotation rollers in the width direction to support the conveyance of photographic materials, and in the bottom area small holes for draining a processing solution, and is provided with caves for putting therein shafts of the rollers; and the other of the sections being an upper section made of a integrally molded material, the lower surface of which has a gently convex form and at least two indented zones for arranging thereon free-rotation rollers in the width direction to support the conveyance of photographic materials, and is provided with caves for putting therein shafts of the rollers;

wherein the upper section is arranged over the tray section so as to secure a space through which photographic materials are passed.

DETAILED DESCRIPTION OF THE INVENTION

The present invention is illustrated below by figures.

Figure 1:
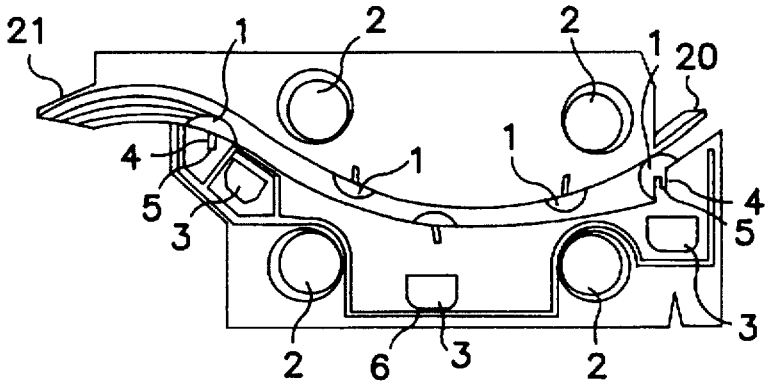
FIG. 1 is a side view showing the outline of a unit part of the present processing device for photographic materials.

FIG. 1 is a side view roughly showing a unit part for the present processing device, which comprises a pair of sections, namely a tray section and an upper section arranged over the tray section, which are each equipped with rollers.

In the figure, the numeral 1 denotes a free-rotation roller, the numeral 2 denotes a hole through which a fastening means is put when two or more of the present sections are joined together via Packing in the width direction, the numeral 3 denotes a hole having a function as a guide hose for drain, the numeral 4 denotes a cave for putting therein a roller shaft, the numeral 5 denotes a roller shaft, and the numeral 6 denotes a groove which is filled with packing upon joining. This packing can inhibit a processing solution from leaking out of the interface of joined tray sections.

Additionally, a photosensitive material is conveyed from the side of the numeral 20 to the side of the numeral 21 through a space, which is formed by the upper surface of a tray section and the lower surface of an upper section arranged over the tray section, with its emulsion side turned downward.

The shape of the aforementioned space and the shapes of attachments fitted on the front and the rear of the upper section (the numerals 20 and 21) are each designed so as to most easily convey photosensitive materials and so as not to damage them.

Figure 2:
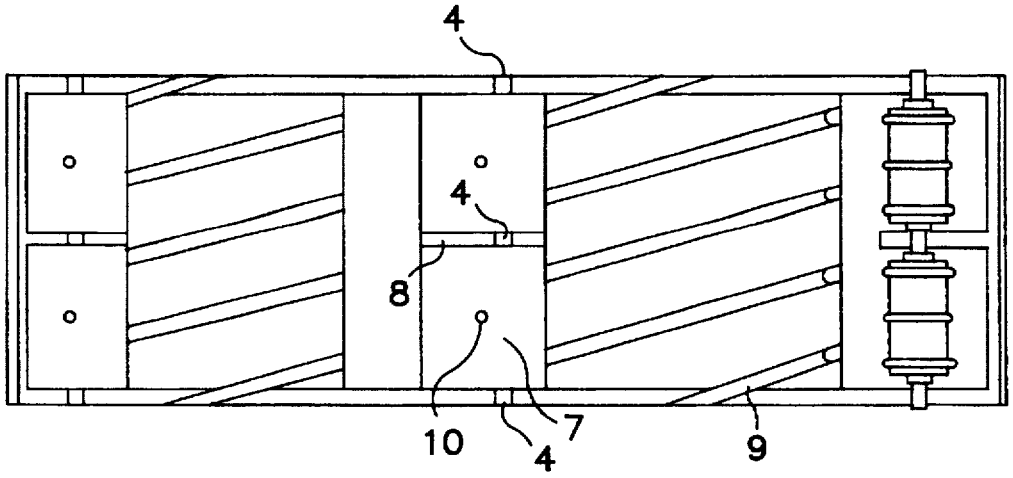
FIG. 2 is a view of the upper surface of a tray section.

FIG. 2 is a view of the upper surface of a tray section. In the figure, the numeral 7 denotes an indented zone on which free-rotation rollers are placed, the numeral 8 denotes a central wall which divides the indented zone into two and supports a roller shaft, and the numeral 9 denotes convex stripe for preventing striation due to the stream of a processing solution from generating on the photosensitive material conveyed thereon. As shown in the figure, it is desirable to arrange the indented zone in at least three places, namely the front and rear ends in the travelling direction of a photosensitive material and the lowest place of the upper surface. Additionally, the number of indented zones can be properly changed depending on the size of a tray section. In the figure, no rollers are yet arranged in two places. The numeral 10 denotes a small hole for recovering a processing solution described hereinafter.

Figure 3:
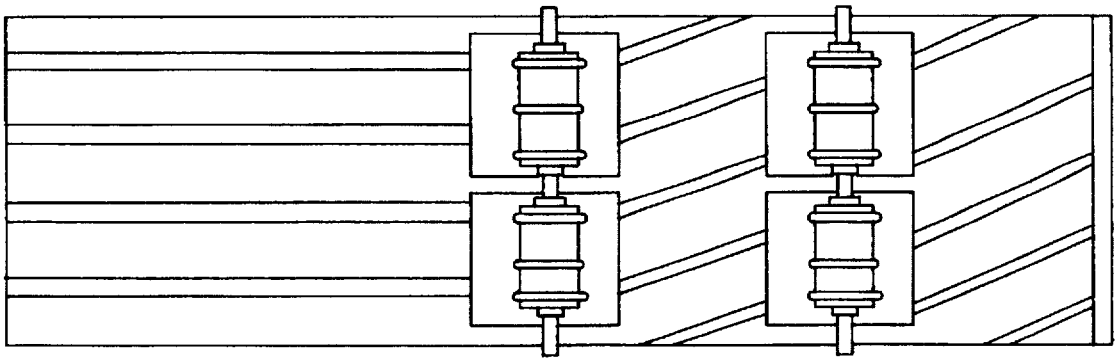
FIG. 3 is a view of the lower surface of an upper section.

FIG. 3 is a view of the lower surface of an upper section. As shown in the figure, it is desirable that the lower surface of the upper section have at least two indented zones in which rollers are to be put. Preferably, these two indented zones are each located at the place corresponding to almost the midway between the indented zones of the tray section located at one end and the lowest place of the upper surface, respectively.

From the viewpoint of mass production, it is desirable that each of the sections composing the present processing device, including a tray section and an upper section but excepting rollers, be molded integrally, e.g., by injection molding. These sections have no particular restriction on their materials. However, plastics are particularly preferred as their materials from the viewpoints of productivity, economical advantage, chemical resistance, and so on.

Figure 4:
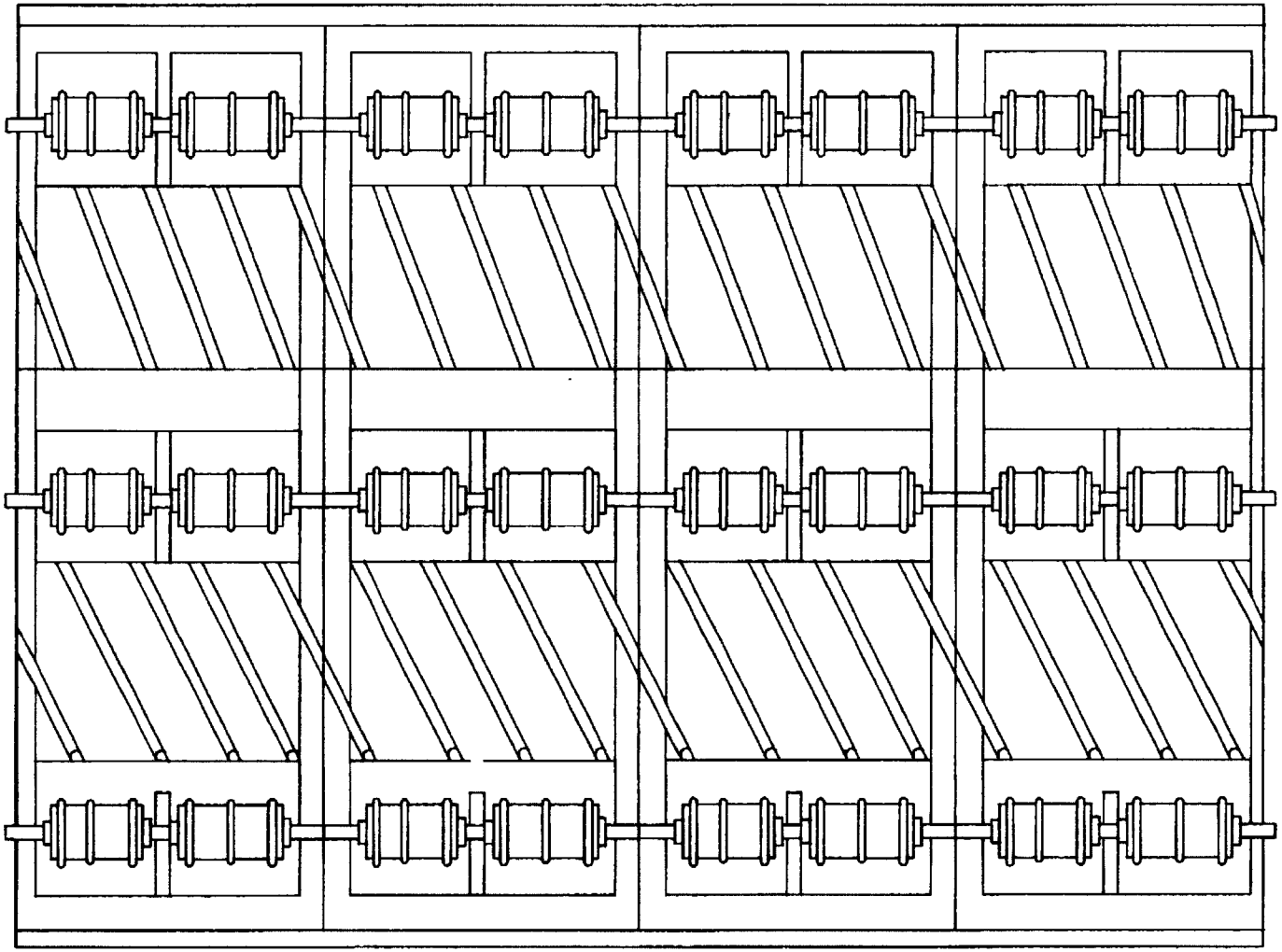
FIG. 4 is a ground plan of four tray sections joined together.

FIG. 4 is a ground plan of a tray part constructed by joining four of the present tray sections.

Figure 5:
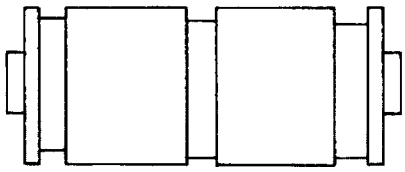
FIG. 5 is a side view of a roller used in the present invention, in which rubber rings are not yet put.
Figure 6:
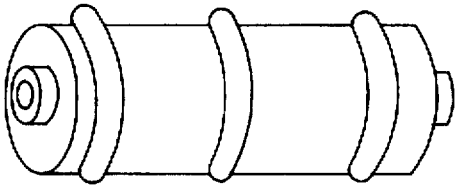
FIG. 6 is an oblique drawing of a roller set with rubber rings.

Free-rotation rollers used in the present invention have no particular restriction so far as they can rotate smoothly to convey photosensitive materials. In view of the property of following up the movement of a photosensitive material and chemical resistance, it is desirable for the rollers to be made of plastics. In particular, rollers with grooves (as shown in FIG. 5) in which rubber rings are set respectively (See FIG. 6) are used to advantage. As for the rubber rings, they are preferably made of a material having physical properties suitable for the type a photosensitive material to be conveyed thereon.

As for the convex stripe 9, a plurality of stripes are formed parallel to one another on the upper plane of the tray section. The shape of each convex stripe and the direction in which it is arranged have no particular restrictions so far as the presence of convex stripes can prevent the striation due to a stream of a processing solution from generating on the surfaces of photosensitive materials processed. In general, however, it is designed so as to have a height of from 0.5 to 2 mm and a width of from 1 to 5 mm. Further, the end part thereof is shaved to make smooth, thereby preventing the end part from catching photosensitive materials. As for the stripes on the upper plane of a tray section in particular, it is preferable that they be formed at a proper angle to the traveling direction of photosensitive materials (in other words, the side edges of the tray section).

The upper section does not necessarily require to have stripes on the lower plane, because it is not brought into contact with the emulsion side of a photosensitive material As it is feared that a photosensitive material under conveyance would be distorted by stripes of the tray section, however, it is desirable for the prevention of such distortion that the upper section also be provided with stripes.

In providing the upper section with stripes, it is desirable to form stripes in the same way as those of the tray section from the viewpoints of simplification of a mould for shaping and reduction of the production cost. In this case, the stripes of the tray section and those of the upper section are inclined at the same angle, but in different directions, to the traveling direction of a photosensitive material when these sections are assembled for practical use.

The size of a unit part for the present processing device, as shown in FIG. 1, can be properly chosen. However, it is desirable to design the unit part to have a size such that, when a plurality of parts are joined together, the stripes 9 are smoothly connected as illustrated in FIG. 4.

For the present processing device, it is desirable that in the vicinity of its inlet for photosensitive materials be installed a switch and/or a sensor for detecting the arrival of a photosensitive material on the inlet and be performed the supply of a processing solution to the emulsion side of a photosensitive material only when the arrival of the photosensitive material is detected.

As for the processing solution, fresh one can be always supplied, or the recovered solution may be used repeatedly as it is replenished with a fresh solution.

The present processing devices are assembled into an automatic developing machine by combining with at least a driving means for conveying photosensitive materials and means for supplying processing solutions. When the processing solution used is a developing solution, the present processing device functions as a developing device; when it is a fixing solution, the device functions as a fixing device; and when it is a washing solution, the device functions as a washing device.

As for the driving means for conveying photosensitive materials, the same means as used for conveying a photosensitive material under exposure is used to advantage, because exposure and subsequent processing operations can be performed continuously.

As for the supply of a processing solution, it is desirable that the processing solution be supplied upwardly to a photosensitive material which is traveling with its emulsion side turned downward. In particular, it is preferred to spray a processing solution onto the emulsion side of a photographic material from the viewpoint of supplying the processing solution in the irreducible minimum amount.

In order to recover the processing solution supplied, and circulate and repeatedly use it according to demand, small holes 10, which are connected to a hole 3 functioning as a guide hose for drain, are formed in the bottom area of each indented zone of the tray section on which rollers are placed. The number and the size of the small holes 10 can be chosen appropriately.

The processing solution recovered via these small holes is passed through the holes 3 described above, and gathered in a tank (which is not shown in FIG. 1).

The recovered processing solution in the tank is abandoned as it is, or reused repeatedly as it is replenished with a fresh processing solution and circulated by a circulating means.

The present processing device, which comprises a pair of the upper and lower parts mentioned above, works as a developing tank in a conventional developing machine when the processing solution applied thereto is a developing solution. Of course, it works as a fixing tank and a washing tank in a conventional developing machine when a fixing solution and a washing solution are respectively used as the processing solution applied thereto.

Accordingly, the gist of an automatic developing machine using the present processing devices is as follows;

When an optically exposed photosensitive material, which is being conveyed by a driving means, is arrived in the vicinity of the present developing device comprising a pair of the upper part and the lower part, a developing solution is supplied thereto and immediately inserted into a space formed between the upper part and the lower part so that the developing solution is spread in a thin film over the surface of the photosensitive material. In the course of the passage through the developing device, the development is effected.

In a case where an exposure apparatus is installed separately from the developing machine, the developing machine can be started at the time of detection of a photosensitive material fed.

In addition to the present developing device, the developing machine generally has a fixing unit and a washing unit within, and processing solutions used in those processing units are each controlled so as to be minimized.

As for least of the developing solution and the fixing solution, all the parts having something to do with these solutions are generally designed so as to reduce their contact areas with air to a minimum for the purpose of preventing the solutions from being exhausted.

In accordance with embodiments of the present invention as mentioned above, the present processing device has many advantages. Specifically, the present device can be made at a very low price because it is a combination of integral molds. Further, the present processing device can easily have a desired size because plastics can be used as the material thereof and a desired number of parts in which rollers are put are joined together in the width direction. Furthermore, the weight of the present processing device is very light because it does not use any conventional large-size rollers. In addition, the rollers can be exchanged in case of necessity, and so the maintenance control is easy.

Additionally, the parts can be joined in the width direction with ease and high accuracy by passing a rod through each of the holes 2 (and fixing it to an outer frame not shown in the figures).

Moreover, since the shapes of the terminals of the present processing device and the shape of a space for conveying a photosensitive material are designed properly, the jamming of photosensitive materials under processing can be markedly reduced, compared with a conventional straight-line conveyance with a large-size roller.

Thus, the present processing device is particularly effective in processing photosensitive materials having a width greater than 1 meter.

What is claimed is:

1. A processing device for photographic materials, comprising as the minimum unit of its parts a pair of sections;

one of said sections being a tray section which is made of an integrally molded material, having an upper surface with a gently concave form and at least three indented zones for arranging thereon free-rotation rollers in the width direction to support the conveyance of photographic materials, each of which indented zones has in a bottom area small holes for draining a processing solution, and is provided with caves for putting therein shafts of the rollers; and the other of said sections being an upper section made of an integrally molded material, having a lower surface which has a gently convex form and at least two indented zones for arranging thereon free-rotation rollers in the width direction to support the conveyance of photographic materials, and is provided with caves for putting therein shafts of the rollers;

wherein the upper section is arranged over the tray section so as to secure a space through which photographic materials are passed.

2. A processing device as described in claim 1, wherein said three indented zones of the tray section are located respectively at both front and rear ends and the lowest place of the upper surface and said two indented zones of the upper section are each located at the place corresponding to almost the midway between the indented zones of the tray section located at one end and the lowest place of the upper surface.

3. A processing device as described in claim 1, wherein each of said indented zones is divided into two by a central wall for supporting a shaft.

4. A processing device as described in claim 1, wherein the upper surface of said tray section is provided with a plurality of convex stripes which are parallel to one another and has a height of from 0.5 to 2 mm and a width of from 1 to 5 mm.

5. A processing device as described in claim 4, wherein the lower surface of said upper section is provided with a plurality of convex stripes which are parallel to one another and has a height of from 0.5 to 2 mm and a width of from 1 to 5 mm.

6. A processing device as described in claim 4, wherein said convex stripes are arranged so as to have an inclination relative to the side edges of the tray section.

7. A processing device as described in claim 6, wherein the convex stripes of said upper section are arranged so that each of the stripes of the tray section and each of the stripes of the upper section overlap each other crosswise when they are projected on a plane.

8. A processing device as described in claim 1, wherein each of said tray and upper sections is made of a plastic material.

9. A processing device as described in claim 1, wherein each of said tray and upper sections is equipped with freerotation rollers.

10. A processing device as described in claim 9, wherein two or more pairs of the sections defined as the minimum unit are joined together in the width direction with packing to form a tray part and an upper part.

11. In an automatic developing machine comprising a processing device, a driving means for feeding a photographic material into the processing device, and a means for supplying a processing solution to an emulsion side of the photographic material, the improvement wherein the processing device is one according to claim 10.

12. An automatic developing machine as described in claim 11, wherein said means for supplying a processing solution works in combination with a means for circulating the processing solution and a means for replenishing a fresh processing solution as required.

* * * * *